United States Patent [19]

Dudasik

[11] Patent Number: 4,812,709

[45] Date of Patent: Mar. 14, 1989

[54] PRIVACY SCREEN FOR A COLOR CATHODE RAY DISPLAY TUBE

[75] Inventor: Edward M. Dudasik, Canoga Park, Calif.

[73] Assignee: Transaction Technology Inc., Santa Monica, Calif.

[21] Appl. No.: 55,735

[22] Filed: May 29, 1987

[51] Int. Cl.[4] ..... H01J 31/00

[52] U.S. Cl. ..... 313/478; 358/252

[58] Field of Search ..... 313/478, 479; 315/85; 358/250, 252, 253, 245, 247

[56] References Cited

U.S. PATENT DOCUMENTS 4,575,767 3/1986 Cohen et al. ..... 358/252 X 4,663,562 5/1987 Miller et al. ..... 313/478

*Primary Examiner*—David K. Moore

*Assistant Examiner*—Sandra L. O'Shea

*Attorney, Agent, or Firm*—Charles H. Schwartz; Ellsworth R. Roston

[57] ABSTRACT

A privacy screen for a color CRT tube to shield images displayed on the color CRT tube film from observers to the sides of an observer in front of the tube. A first light control film contains a plurality of closely spaced louvers and is located in front of the color CRT tube. The louvers are positioned at a tilt angle relative to a vertical line and at a first direction relative to the vertical line. A second light control film contains a plurality of closely spaced louvers and is located in front of the CRT tube and the first light control film. The louvers of the second film are positioned at a tilt angle relative to the vertical line and at a second direction relative to the vertical line and opposite to the first direction of the louvers of the first film. The tilt angles of the louvers of the first and second films provide for a substantial reduction of any visual moire patterns produced by an interaction between the images on the color CRT tube and the first and second light control films while providing privacy for the images on the color CRT tube.

4 Claims, 3 Drawing Sheets

FIG. 1
PRIOR ART
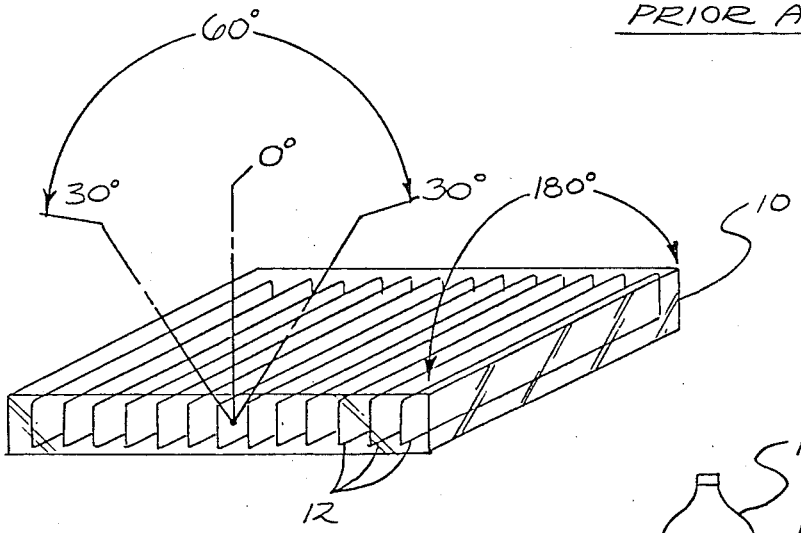
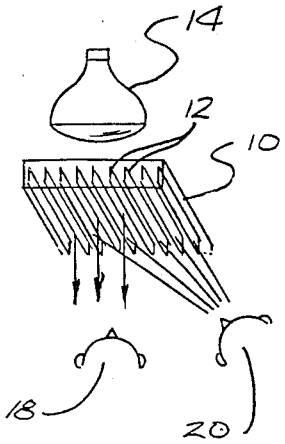
FIG. 2
PRIOR ART
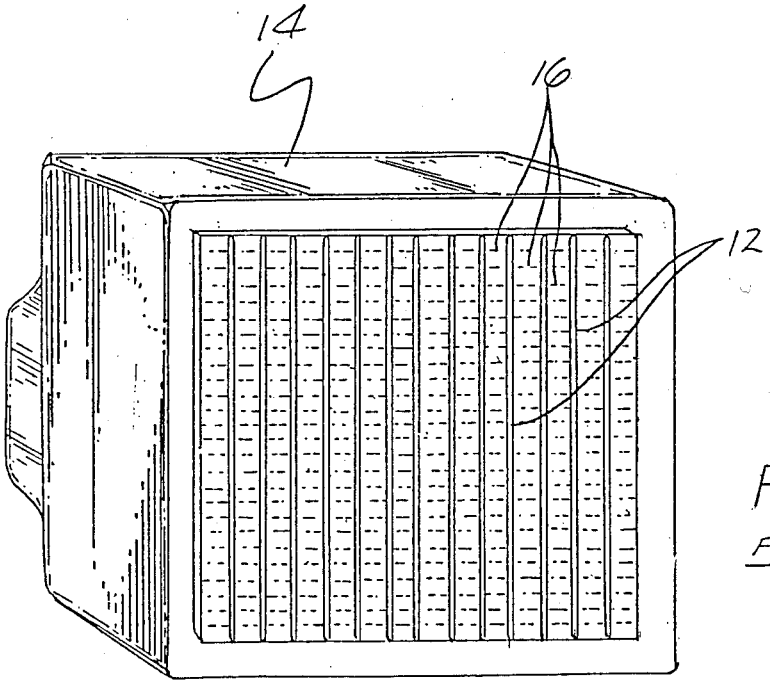
FIG. 3
PRIOR ART

PRIVACY SCREEN FOR A COLOR CATHODE RAY DISPLAY TUBE

BACKGROUND OF THE INVENTION

1. Field of the Invention

The present invention relates to a privacy screen to provide for private viewing of images on a display provided by a color cathode ray tube. The privacy screen of the present invention allows for images on the color cathode ray tube to be visible to an observer directly in front of the tube, but with the images on the color cathode ray tube shielded from observers positioned on either side of the observer in front of the color cathode ray tube.

2. Background of the Prior Art

Various types of display screens are used for transactional purposes. For example, many banking transactions are now carried out using an automatic teller machine (ATM) and with the customer interacting with a terminal including a display screen to perform a banking transaction. During this banking transaction, the display screen may provide images which include information about the customer's account or accounts and the customer, typically, would prefer this information to be retained in confidence and not visible to other customers of the bank.

The customer would normally shield the information on the display screen from any other customers behind the customer performing the financial transaction. However, the information on the display screen would be readily visible to any persons located to either side of the customer performing the financial transaction. It is, therefore, desirable to provide for a means of insuring privacy of the information presented as images on the display screen from persons located to either side of the customer.

The prior art has provided for structures that are used to provide for the above described privacy for black and white or monochrome cathode ray tubes. With these monochrome cathode ray tubes, the lines of information forming the images on the tube are horizontal. The privacy is provided by a light control film, such as a light control film sold by the Industrial Optics division of 3M Company. This 3M light control film (LCF) is a thin plastic film containing closely spaced black microlouvers. The film simulates a thin venetian blind to shield out unwanted ambient light and direct the display light of the CRT tube so that this light is visible only through a particular viewing angle.

The light control film (LCF) is used with the monochrome CRT by having the louvers of the film positioned vertically relative to the horizontal lines of the monochrome CRT. This structure works well in providing privacy and the viewing angle would be dependent on the physical characteristics of the closely spaced microlouvers including the spacing between the louvers, the thickness of the louvers and the depth of the louvers. The light control film (LCF) also has other advantages in enhancing the contrast of the electronic display and can block unwanted external light which would tend to cause reflections and thereby make the display more difficult to read.

Unfortunately, the light control film (LCF) cannot be used with a color CRT in a normal way with the film having the louvers positioned vertically relative to the color CRT. This is because the dot matrix for a color CRT provides for more than horizontal lines. Specifically, a plurality of lines are provided in a color CRT including horizontal lines, vertical lines and angular lines. If a prior art light control film (LCF) is positioned in front of a color CRT, then the interaction of the different lines on the color display with the vertical louvers provide for moire patterns including wave patterns and ring patterns on the display. It can be appreciated that such moire patterns would defeat the visibility of the images on the display and although the prior art light control film might provide for privacy with a color CRT, the privacy would be useless since the images would be effectively lost within the moire patterns.

SUMMARY OF THE INVENTION

The present invention provides for private viewing of the images on a color CRT by using the existing light control film (LCF) technology in a novel manner so as to eliminate the visual disturbance of the moire pattern. As indicated above, these moire patterns can result from the interaction of the louver blind elements in the light control film with the physically aligned color phosphor dots on the CRT which exist along vertical and angular lines.

In particular in the present invention, two light films (LCF), or filters are placed one on top of the other over the face of the color CRT. The filters are placed to have the louver blind elements of each of the filters at an angle from the vertical. The louver elements of each filter are pitched at the same angle but in opposite directions to each other. Therefore, if one of the filters has the louver elements pitched at a particular angle A from the vertical, the other filter has its louver elements pitched at the same angle A from the vertical, but in the opposite direction. The particular angle at which the louver elements are pitched is referred to the tilt angle. The particular tilt angle is important since the moire patterns will decrease in their disturbance to the viewer as the absolute value of the tilt angle is increased. However, the degree of disturbance of the moire patterns does not follow a linear change, but rather has peaks and valleys and one aspect of the present invention is to use tilt angles to provide for a minimum disturbance of the moire patterns and yet allow for the use of filter material which is currently available.

Specifically, the light control filters that are currently available are only available in widths up to twelve inches (12") measured normal to the direction of the louver elements. This means that in order to provide for complete coverage of the face of the CRT, the tilt angle must be limited to a value that is a function of the height and width of the exposed face of the CRT. This means that the light control filter can only be rotated to a maximum tilt angle beyond which the viewer will observe that the filter material does not complete cover the exposed face of the CRT.

Fortunately, as indicated above, the variation in degree of disturbance occurs for values of the tilt angle as the tilt angle increases, but with the variation in degree of disturbance having peaks and valleys and with the valleys being progressively reduced. It is, therefore, possible to provide for a selection of a tilt angle to be less than the maximum tilt angle referred to above so that the filter material does completely cover the exposed face of the CRT, but also to have a value which corresponds to a relatively low degree of moire pattern disturbance.

In a particular embodiment of the invention, the maximum tilt angle which could be provided and still completely cover the exposed face of the CRT was approximately eighteen degrees (18°). At approximately fourteen degrees (14°), which is less the maximum tilt angle of eighteen degrees (18°), the moire patterns provided a relative low level of disturbance and were bearly noticable. Therefore, in one specific embodiment of the invention, a tilt angle of approximately fourteen degrees (14°) is used.

DETAILED DESCRIPTION OF THE PREFERRED EMBODIMENT

A clearer understanding of the present invention will be had with reference to the following description and drawings wherein.

FIG. 1 illustrates a drawing of a prior art light control film formed by a plastic film containing closely spaced black microlouvers;

FIG. 2 illustrates the prior art light control film placed in front of a monochrome CRT tube to provide for a privacy screen;

FIG. 3 illustrates the prior art privacy screen showing the relationship of the monochrome CRT lines relative to the vertical louvers;

Figure 4:
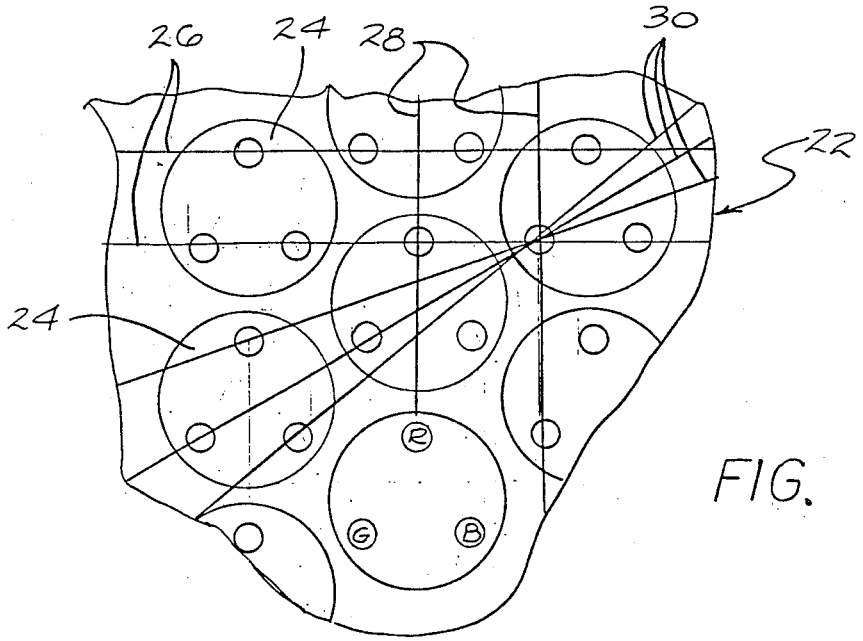
FIG. 4 illustrates a portion of the dot matrix for a color CRT illustrating the variety of lines other than horizontal lines.

FIG. 1 illustrates the prior art light control film which may be used as a privacy screen or filter. As can be seen in FIG. 1, a film 10 contains a plurality of closely spaced microlouvers 12. The film simulates a tiny venetian blind to shield out unwanted ambient light and direct the display light of an electronic display such as a CRT tube in a particular direction. In particular, light passing through the film normal to the film and at a zero angle has its transmission reduced primarily by the thickness of the louver. This is because the thickness of the louvers do reduce the amount of light passing through as would be with any type of screen.

As shown in FIG. 1 the film, for example, may provide for the transmission of seventy five percent (75%) of the maximum light. When the light is viewed at an angle relative to the surface, then the transmission of light is further reduced. For example, at fifteen degrees (15°) off the normal axis, the transmission is shown to be reduced to thirty five percent (35%) and at thirty degrees (30°) the light is shown to be completely cut off.

These transmissions are relative to viewing the light along the X axis as shown in FIG. 1. Along the Z axis, the viewing of the light would be through the entire one hundred and eighty degrees (180°), again as shown in FIG. 1. Therefore, for the example shown in FIG. 1, the total viewing angle would be sixty degrees (60°) which is thirty degrees (30°) on either side of the normal axis.

It should, of course, be appreciated that these angles may be increased or reduced depending upon the characteristics of the louvers, such as the spacing of the louvers and the depth of the louvers. As a particular example, light control film sold by the Industrial Optics division of 3M Company is available with total viewing angles of forty eight degrees (48°), plus or minus six degrees (6°), sixty degrees (60°), plus or minus eight degrees (8°) and ninety degrees (90°) plus or minus fifteen degrees (15°). If maximum privacy is desired, then the smaller total viewing angle light control film would be used.

FIG. 2 illustrates the prior art technique of positioning the light control film 10 of FIG. 1 relative to a monochrome CRT tube. Specifically as shown in FIG. 2, a monochrome CRT tube 14 has positioned in front of it the light control film 10 with the louver elements running in a vertical direction relative to the horizontal lines of the monochrome CRT tube. This can be seen in more detail in FIG. 3 where the vertical louvers 12 are shown relative to horizontal lines 16 of the CRT tube 14. As shown in FIG. 2, the display on the CRT tube 14 is visible to an observer 18, but not visible to an observer 20 who is outside of the viewing angle of the light control film 10.

Although the privacy system shown in FIGS. 1–3 works well with monochrome CRT tubes. The light control film does not work well with color CRT tubes. This may be seen with reference to FIG. 4 where a small portion of the face of a color CRT tube 22 is shown. The face of a color CRT tube includes a plurality of red, green, blue dot matrixes as shown by the dot matrixes 24. Each dot matrix includes separate red, green and blue phosphor dots so as to provide for the proper color image on the display screen of the CRT tube 22. This is in distinction to a monochrome CRT which normally includes phosphors for providing a plurality of horizontal lines on the face of the tube as shown in FIG. 3.

Because of the plurality of individual dots with a color CRT tube, lines other than horizontal lines are produced on the face of the tube 22. Specifically, in addition to horizontal lines 26, vertical lines 28 and a variety of different angular lines 30, are produced on the face of the color CRT 22. The variety of the different lines produced by the individual color phosphor dots interact with the louvers 12 of the light control film so as to produce moire patterns which are very distracting to the viewer of the images on the color CRT. Therefore, it is not possible to position a light control film with the louvers vertical in front of a color CRT screen to provide privacy.

Figure 5:
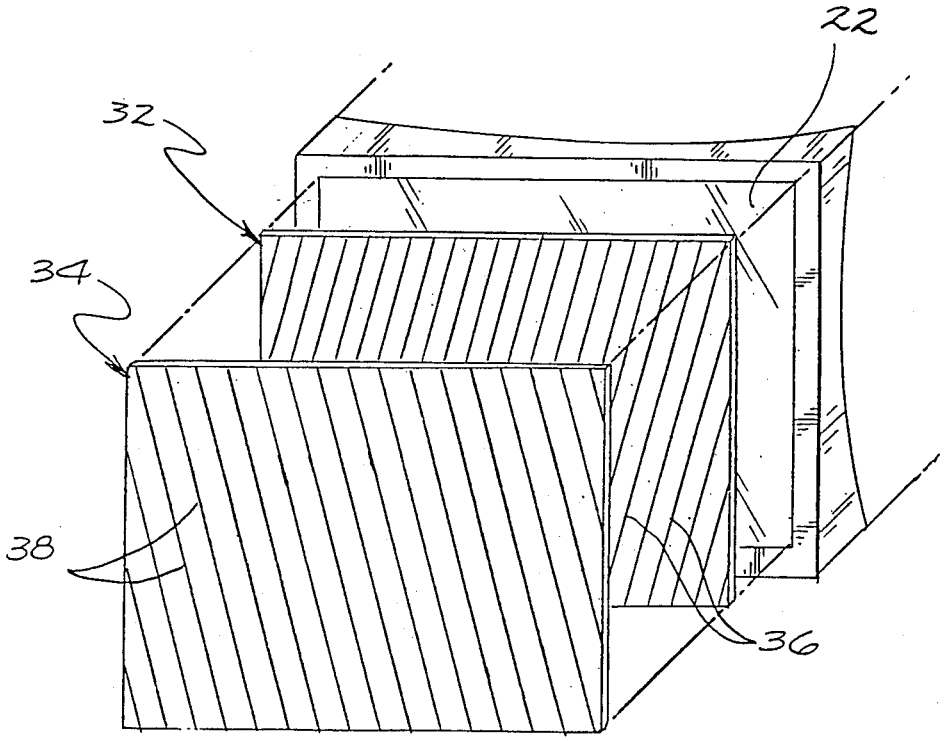
FIG. 5 illustrates the present invention showing a pair of filter elements oriented at opposite tilt angles from the vertical relative to the CRT.

The present invention provides for a structure to overcome the above problem by using a pair of light control films positioned on the face of the CRT, but with each film and its louvers tilted at equal but opposite angles to each other to provide for privacy, but at the same time significantly reducing the moire patterns. This can be seen in FIG. 5, where the color CRT tube 22 has positioned in front of it a first light control film 32 and a second light control film 34. Each light control film includes louver elements, such as louver elements 36 of film 32 and louver elements 38 of film 34. The tilt angle, as shown in FIG. 5 is substantially the same for the louvers 36 and 38 of both films 32 and 34, but in opposite directions. The films 32 and 34 may be substantially identical to that shown in FIGS. 1 and 2 and with the louvers 36 and 38, again being substantially identical to the louvers 12 shown in FIGS. 1 and 2.

The angle in which the louvers are pitched relative to vertical is important. This angle, as indicated above, is referred to as the tilt angle. It has been determined that the moire patterns observed will vary in their degree of disturbance to the viewer as the absolute value of the tilt angle is increased. This can be seen with reference to the graph of FIG. 6 where the intensity of the moire patterns is plotted relative to the increasing tilt angle.

It can be seen that when the louvers are at a vertical, the moire patterns are extremely disturbing. This decreases down to a first valley point between zero (0) and five (5) degrees, but even at the first valley point the moire patterns would still be noticable. The intensity of the disturbance of the moire pattern then continues to decrease with subsequent peaks and valleys as the tilt angle is increased.

Figure 6:
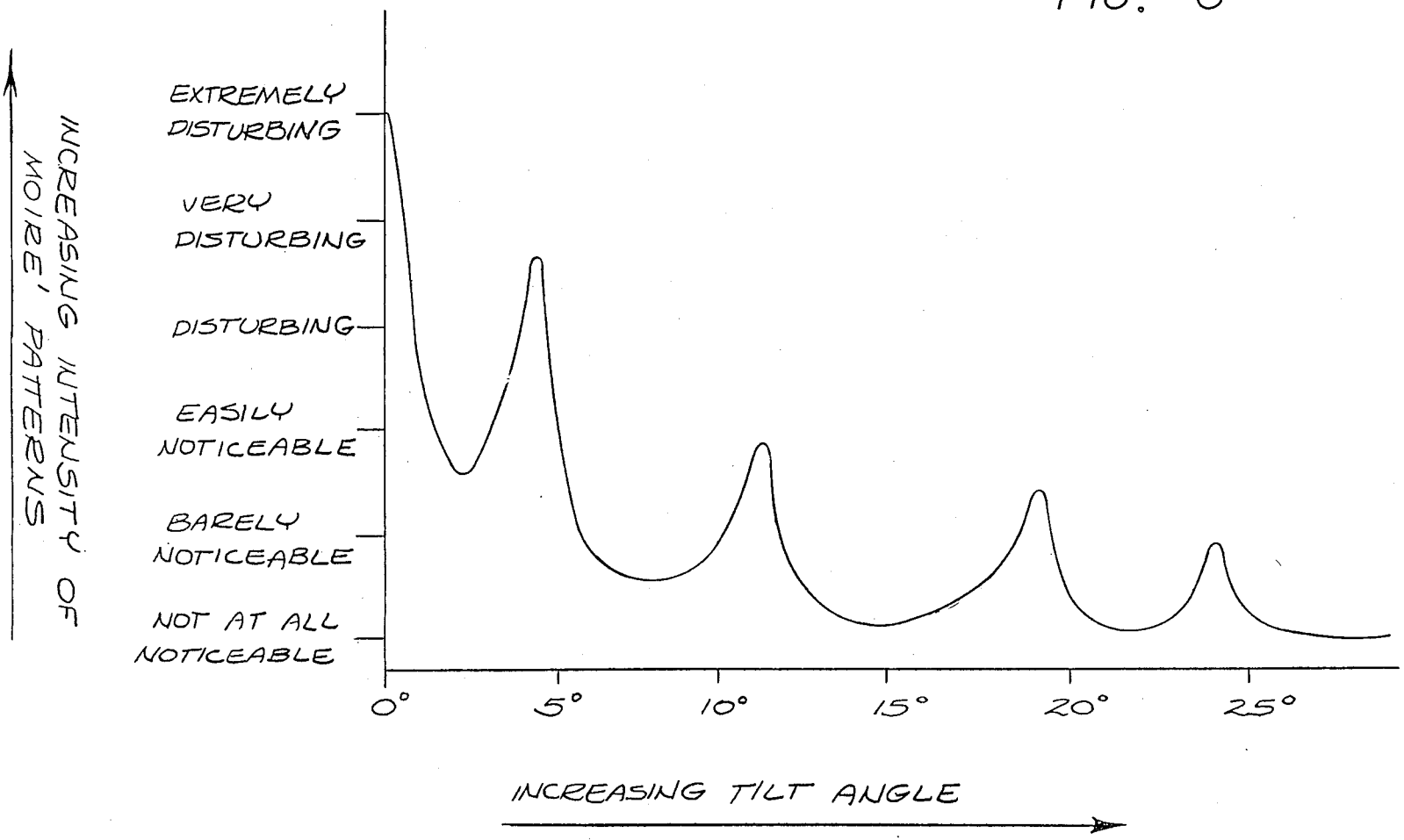
FIG. 6 is a graph showing the intensity of the moire patterns visible to an observer with increasing tilt angle.

There are, however, practical limitations on the maximum tilt angle that can be used. First, the available width of the light control film is a limitation since as the tilt angle is increased, the filter material will not completely cover the exposed face of the CRT. This is because, at this time, the light control films are available only up to widths of twelve inches (12"). This provides a maximum tilt angle for the normal color CRT tubes currently in use for ATM applications of approximately eighteen degrees (18°). As can be seen in FIG. 6, a tilt angle of eighteen degrees (18°) provides for a point close to a peak and so in a particular preferred embodiment of the invention, a tilt angle of approximately fourteen degrees (14°), which is in the valley, is chosen.

It should also be noted that as the tilt angle is increased, the degree of privacy may be reduced. This is because if the tilt angle is increased to too large a value, it may be possible for a short or tall observer to the side to be able to see the images on the CRT tube, because the louvers would no longer provide for the same privacy characteristics. This one of the reasons why two (2) light control films are used since the opposite tilting of the louvers tends to increase the privacy on both sides. In addition, the two (2) filters also interact to enhance the reduction of the moire patterns and thereby allow for the provision of privacy with a minimum disturbance caused by the moire patterns.

The present invention, therefore, provides for the selection of the tilt angle to be at one of the points of minimum disturbance in the series of peaks and valleys and also be less than the maximum tilt angle which is controlled by the width of the filter material relative to the size of the CRT screen. As indicated above, for a normal width of twelve inches (12") for the light control film and a CRT screen typically used with ATM's, the selected tilt angle is approximately fourteen degrees (14°).

It should be appreciated that different CRT screens may provide for intensities of moire patterns having peaks and valleys at different points relative to increasing tilt angles other than that shown in FIG. 6. This would be because of differences in structure in a particular dot matrix relative to the sizes and dimensions of the louvers in the light control films. However, the general principles will still apply in that the light control films will be tilted to an angle to provide for a minimum intensity of the moire patterns at one of the valleys and with the tilt angle less that the maximum tilt angle as controlled by the physical constraints of the width of the light control film relative to the size of the CRT tube. These general characteristics will provide for an optimal tilt angle for particular CRT tubes and particular light control films. The basic characteristics are to provide for two (2) such light control films, both located at a particular tilt angle but with the tilt angle of one light control film opposite to the tilt angle of the other.

Although the invention has been described with reference to a particular embodiment, it is to be appreciated that various adaptations and modifications may be made and the invention is only to be limited by the appended claims.

I claim:

1. A privacy screen for a color CRT tube to shield images displayed on the color CRT tube film from observers to the sides of an observer in front of the tube, including a first light control film containing a plurality of closely spaced louvers located in front of the color CRT tube and with the louvers positioned at a tilt angle relative to a vertical line and at a first direction relative to the vertical line, a second light control film containing a plurality of closely spaced louvers located in front of the CRT tube and the first light control film and with the louvers of the second film positioned at a tilt angle relative to the vertical line and at a second direction relative to the vertical line and opposite to the first direction of the louvers of the first film, the tilt angles of the louvers of the first and second films providing a substantial reduction of any visual moire patterns produced by an interaction between the images on the color CRT tube and the first and second light control films while providing privacy for the images on the color CRT tube, and the tilt angles for the louvers of the first and second films are equal and opposite relative to the vertical line and with the angle between the louvers of the first and second films less than 50°.

2. The privacy screen of claim 1 wherein the intensity of the moire patterns relative to an increase in the tilt angles varies between peaks and valleys with a progressive decrease in intensity and with the tilt angles chosen to correspond to the intensity of the moire patterns in a valley.

3. The privacy screen of claim 2 wherein the light control film is available at a particular maximum width and with a maximum tilt angle determined by the maximum angle at which the light control film can be positioned without exposing a portion of the color CRT tube and with the tilt angles chosen to correspond to the valley immediately prior to the maximum tilt angle.

4. The privacy screen of claim 3 wherein the tilt angles are approximately 14°.

* * * * *